US008540029B2

(12) United States Patent
McMiles

(10) Patent No.: US 8,540,029 B2
(45) Date of Patent: Sep. 24, 2013

(54) SYSTEM AND APPARATUS FOR DRILLING RISER CONDUIT CLAMP

(75) Inventor: Barry J. McMiles, Houston, TX (US)

(73) Assignee: The Subsea Company, Houston, TX (US)

( * ) Notice: Subject to any disclaimer, the term of this patent is extended or adjusted under 35 U.S.C. 154(b) by 10 days.

(21) Appl. No.: 12/683,875

(22) Filed: Jan. 7, 2010

(65) Prior Publication Data

US 2010/0175885 A1 Jul. 15, 2010

Related U.S. Application Data

(60) Provisional application No. 61/204,760, filed on Jan. 9, 2009.

(51) Int. Cl.
*E21B 7/12* (2006.01)

(52) U.S. Cl.
USPC ..... 166/348; 166/345; 166/367; 166/359

(58) Field of Classification Search
USPC ..... 166/348, 345, 367, 339–344, 359, 166/360, 365, 378, 382, 77.51, 89.1, 83.1
See application file for complete search history.

(56) References Cited

U.S. PATENT DOCUMENTS

| | | | | |
|---|---|---|---|---|
| 3,729,756 | A * | 5/1973 | Cook et al. | 441/133 |
| 4,249,610 | A * | 2/1981 | Loland | 166/360 |
| 4,477,207 | A * | 10/1984 | Johnson | 405/195.1 |
| 4,662,785 | A * | 5/1987 | Gibb et al. | 405/195.1 |
| 6,004,074 | A * | 12/1999 | Shanks, II | 405/195.1 |
| 6,155,748 | A * | 12/2000 | Allen et al. | 405/195.1 |
| 7,210,531 | B2 * | 5/2007 | van Belkom | 166/367 |
| 7,628,665 | B1 * | 12/2009 | Cook et al. | 441/133 |
| 7,762,337 | B2 * | 7/2010 | Papon et al. | 166/345 |
| 7,861,982 | B1 * | 1/2011 | McClure | 248/74.1 |
| 7,988,104 | B1 * | 8/2011 | Cook et al. | 248/68.1 |
| 2008/0245933 | A1 * | 10/2008 | Stokes | 248/74.1 |
| 2008/0251668 | A1 * | 10/2008 | Stokes | 248/230.4 |
| 2009/0272855 | A1 * | 11/2009 | Oram | 248/67.5 |
| 2011/0042095 | A1 * | 2/2011 | Sessions et al. | 166/360 |

* cited by examiner

*Primary Examiner* — Matthew Buck
*Assistant Examiner* — Aaron Lembo

(57) ABSTRACT

A clamp for securing about annular casing via a centrally oriented aperture having a radius includes at least one aperture for grasping a longitudinally extending accessory disposed about the radius of the centrally oriented aperture and at least one fastening member for securing the longitudinally extending accessory about the clamp. At least one fastening member and at least one aperture act to secure a longitudinally extending accessory relative to the annular casing.

17 Claims, 2 Drawing Sheets

SYSTEM AND APPARATUS FOR DRILLING RISER CONDUIT CLAMP

CROSS REFERENCE TO RELATED APPLICATIONS

This application claims priority to U.S. Provisional Patent Application No. 61/204,760, filed 9 Jan. 2009, titled "System and Apparatus for Drilling Riser Conduit Clamp."

BACKGROUND OF THE INVENTION

1. Field of the Invention

The present invention relates to a system and method for clamping, engaging and disengaging conduit connections in oil and gas wellhead risers, wherein the wellhead equipment of the well is positioned below the surface of the water.

2. Description of Related Art

In subsea drilling operations, as in any drilling operation, drilling fluid must be circulated through the drill bit in order to cool the bit, carry away the cuttings and provide hydrostatic head pressure against the formation to aid in the prevention of blowouts. This drilling fluid is normally returned to the floating vessel by means of a large diameter pipe, known as a riser, which extends between the subsea wellhead assembly and the floating vessel or rig at the water's surface. The lower end of this riser is connected to the BOP and wellhead assembly which is generally located adjacent the ocean floor, and the upper end usually extends through a centrally located opening of the floating vessel or fixed rig. A drill string extends downward through the riser into earth formations lying below the body of water, and drilling fluids circulate downwardly through the drill string, out through the drilling bit, and then upwardly through the annular space between the drill string and the riser, returning to the vessel or rig.

Buoyancy or ballasting devices may be attached to the submerged portion of the riser. These devices may be comprised of syntactic foam attached on the outer elements of the riser section. These buoyancy devices create upwardly directed forces in the riser, compensating for the compressive stresses created by the riser's weight preventing riser failure.

In an underwater drilling rig riser, multiple lines are integrated in the rig riser. These include multiplexed hydraulic lines, choke lines, boost lines and an Installation/Workover Control Systems (IWOCS) line. In conventional installations, the failure of a riser or its release from the subsea installation due to tripping of a blowout preventer cuts these various lines as they are integrated in the riser. The present invention presents an improved riser clamp to securely hold the various lines in place as well as allowing for the selective release of the all important IWOCS line away from the riser for easy replacement or continued control of the subsurface wellhead assembly.

BRIEF SUMMARY OF THE INVENTION

In accordance with a preferred embodiment of the invention, there is shown a clamp for securing about annular casing via a centrally oriented aperture having a radius having at least one aperture for grasping a longitudinally extending accessory disposed about the radius of the centrally oriented aperture, and at least one fastening member for securing the longitudinally extending accessory about the clamp, wherein the at least one fastening member and the at least one aperture act to secure a longitudinally extending accessory relative to the annular casing.

The primary advantage of the invention is to improve equipment reliability by providing a clamp to hold subsurface control lines within the confines of an underwater drilling rig riser and allow easy access to said lines for maintenance, replacement or separation from the riser in case of failure.

Another advantage of the invention is that the line clamps are integrated to provide support for the permanently attached lines to prevent the buckling of the lines during pressurization.

Another advantage of the invention is that the clamps holding the removable lines, which are fitted and removed during a riser run/pull do not have to be physically removed as per the conventional systems and are locked inside the floatation perimeter to prevent damage and creating a safety hazard on board the rig or platform.

Other objects and advantages of the present invention will become apparent from the following descriptions, taken in connection with the accompanying drawings, wherein, by way of illustration and example, an embodiment of the present invention is disclosed.

BRIEF DESCRIPTION OF DRAWINGS

The invention and its preferred embodiments and preferred mode of use and further objectives and advantages thereof, will best be understood by reference to the following detailed description when read in conjunction with the accompanying drawings, wherein.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the issued claims and as a representative basis for teaching one skilled in the art to employ the present invention in virtually any appropriately detailed system, structure or manner.

In oil, gas and mineral production various hydraulic operated pumps; valves, connectors, tubing and piping are used to extract oil, gas or other minerals from the subsurface strata. These devices are arranged in a manner to safely extract oil, gas or other minerals in a liquid or gaseous form under pressure and allow redundancy in case of failure of one or more of the component parts. To that end, drilling riser component parts are typically integrated into sustained operations of an oil, gas or mineral field.

Figure 1:
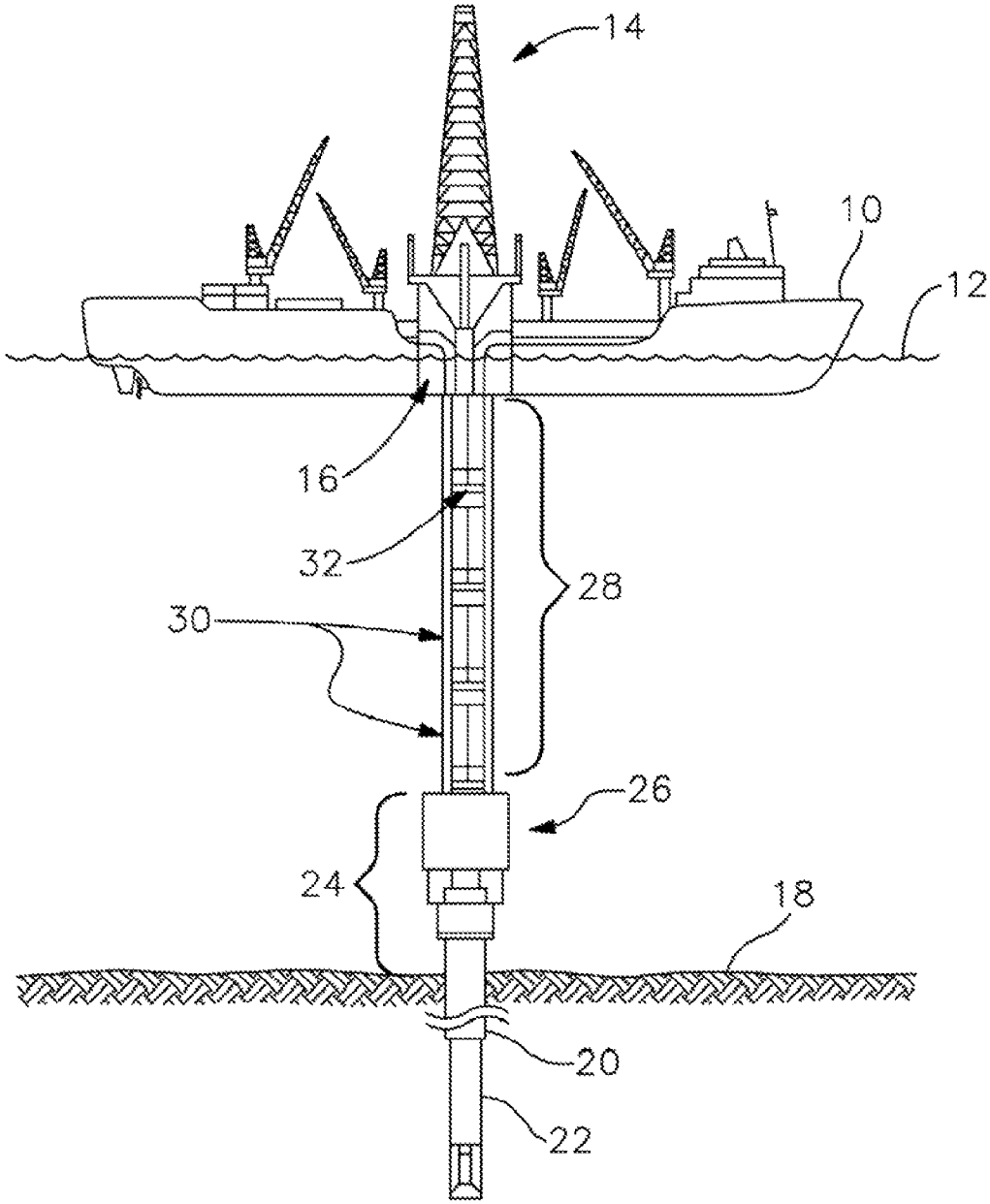
FIG. 1 illustrates an offshore drilling system configured for dual gradient riser drilling and depicting riser clamps in gapped areas between riser floatation modules.

In a preferred embodiment, FIG. 1 illustrates a typical offshore drilling site where a drilling vessel 10 floats on a body of water 12 which overlays a pre-selected drill site. Drilling rig 14 is positioned in the middle of drilling vessel 10, above moon pool 16. Moon pool 16 is a walled opening that extends through drilling vessel 10 and through which drilling tools are lowered from drilling vessel 10 to a sea floor or mudline 18. At mudline 18, structural pipe 20 extends into wellbore 22. Wellhead assembly 24 and adjacent blowout preventer 26 are run to mudline 18. A riser system 28 as shown in FIG. 1 typically includes one or more auxiliary lines (well-control lines and boost line) on the outside of a riser. As is illustrated in FIG. 1, a plurality of buoyant floats 30 surrounds a riser. A plurality of well control lines such as a choke line, multiple hydraulic lines, boost line and integrated components are either embedded within the floats running parallel with the riser or adjacent to the riser floats. Between each float is riser, clamp (32) which securely holds the well control lines in place with the riser floats or adjacent to the riser floats.

Drilling vessel 10 can include additional riser clamps 32 which can be employed to hold various pieces of equipment. For example, in certain embodiments, as is shown in FIG. 1, a riser clamp 32 may be disposed near the opening of the moon pool and used to maintain a piece of equipment that is not susceptible to high pressures, such as a device employed to measure water temperature and current flow. At another depth, as is illustrated near the middle of the drill string in FIG. 1, another riser clamp 32 can be employed to further maintain the same or another line. At an even deeper location, an additional riser clamp 32 can be employed to maintain another line or series of lines which can be used for yet another purpose, such as powering a device measuring the flow rate of fluids flowing through.

In numerous instances, a single line or a plurality of lines can be connected to each of riser clamps 32. In certain embodiments one line may adapt to one riser clamp located at a particular depth and adapt to another riser clamp at another depth, after bypassing one or more riser clamps. Riser clamps 32 may be employed to draw tension among one or more lines running along various lengths of riser system 28. In certain embodiments a singular riser clamp 32, similar to what is shown in FIG. 1, can be located near the ocean floor can be employed to couple a line near the bottom of the ocean floor, in order to allow a line to move almost independent of riser system 28. Such an embodiment would be ideal in the event that a drill string needed to be removed from the ocean floor. Numerous riser clamps 32 can be employed and allowed to independently and selectively release various lines as becomes necessary. Such an embodiment would be ideal in the event that numerous lines were coupled to riser system 28 and only particular lines needed to be released from riser system 28 at various depths. For example, in the event that a particular event occurs such as completion of a fracturing technique and only particular lines of communication need to be maintained, riser clamps 32 that are used to maintain a line measuring fluid flows can be selectively released from riser system 28, while lines measuring bottom hole pressure can be a maintained at their present position. Allowing for selective removal of lines along riser system 28 via riser clamps 32 provides for a lack of congestion along a typical string. Further, when particular lines carrying various signals are allowed to be selectively removed prior to removal of a riser system 28 from the ocean floor, the potential for tangling of lines is severely reduced.

Figure 2A:
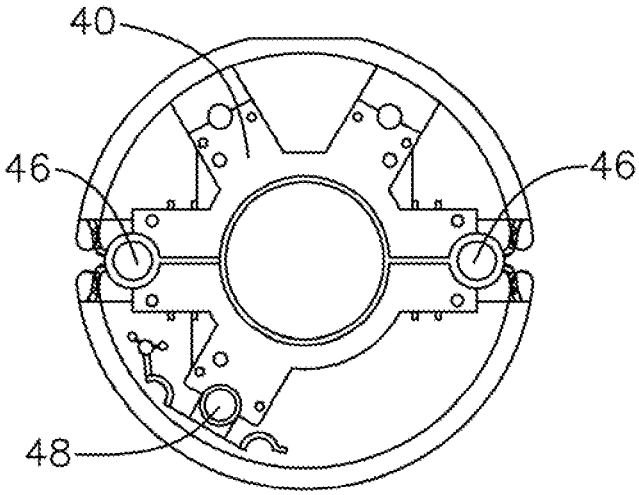
FIGS. 2A and 2B illustrate a riser clamp in accordance with a preferred embodiment of the present invention.
Figure 2B:
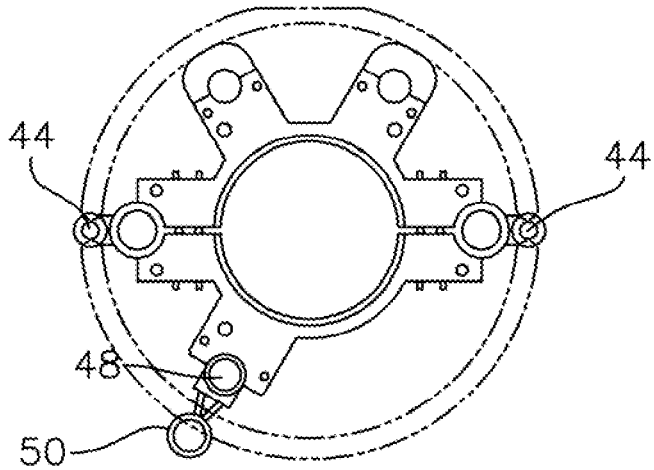

FIGS. 2A and 2B illustrate cross sectional views of an exemplary riser clamp of the preferred embodiment of the invention in both the closed (FIG. 2A) and open (FIG. 2B) positions. Riser clamp 40 fits around drilling rig riser 42 and securely holds multiplexed electronic and hydraulic line clamps 44, choke lines 46, boost line 48 and an Installation/Workover Control Systems (IWOCS) line clamp 50. As shown, two extensions support choke lines 46 and line clamps 44 shown in FIG. 2B. One extension supports a clasp that holds boost line 48 and IWOCS line clamp 50. Clamp 40 may be made of plastic or any other material and is fashioned to allow IWOCS line clamp 50 and multiplex electronic & hydraulic line clamps 44 to permit disengagement from the riser assembly when clamp is in the open position (FIG. 2B) and the riser is being pulled. FIG. 2B shows the position of the floatation riser situated against the flat top of the riser clamp on five radial extensions. Clamp 50 is outside the periphery of the flotation when in the closed positioned. See FIG. 1 which shows a series of clamps 32 positioned above each section of floatation 30. Clamp 50 may be configured with, detents positioned to hold the clamp in an open position when not in use or when being pulled.

In certain embodiments, clamp 40 can be employed to secure about riser system 28 via a centrally oriented aperture having a radius. At least one aperture for grasping a longitudinally extending accessory such as a choke line, a hydraulic line, a boost line or other integrated components is disposed about the radius of a centrally oriented aperture. Additionally, at least one fastening member such clamp 40 may be employed for securing a longitudinally extending accessory such as a line choke, a hydraulic line, a boost line or other integrated components about clamp 40. In certain embodiments, at least one fastening member and at least one aperture may act to secure a longitudinally extending accessory relative to riser system 28. In certain embodiments, riser system 28 may be annular casing or any other type of drill string.

In particular embodiments, similar to what is shown in FIG. 2A, riser clamp 40 can include a casing component, which provides for protection and security of a line or other member secured by riser clamp 40. In such embodiments, as is illustrated in FIG. 2A riser clamp 40, may be coupled to an opposing portion of riser clamp 40, via a mechanism that allows a riser clamp 40 to swing out, while maintaining its coupling to another portion of riser clamp 40. In other embodiments, riser clamp 40 can be made such that portions of riser clamp 40 detachably configure as separate components to couple with one another around a riser or portion of a riser. In certain embodiments, portions of riser clamp 40 can be configured to allow lines, cables or tubing, to attach once riser clamp 40 is coupled to a riser or portion of a riser. For example, as is illustrated in FIG. 2A, riser clamp 40 can first be coupled and secured to a riser via aperture 42. Proper lines may then be disposed about riser clamp 40 via apertures 46 and 48 and subsequently remaining portions of riser clamp 40 may then be connected to secure lines in place.

In other embodiments, riser clamp 40 can be oriented such that numerous lines individually couple to exterior portions as is illustrated in FIG. 2B. In this particular embodiment, lines may extend through individual apertures and are capable of being released through individual clamping mechanisms. Such clamping mechanisms are ideal in high pressure environments and those in which certain lines are capable of collapsing due to changes in pressure and temperature.

In certain embodiments, multiple apertures may be employed for coupling longitudinally extending accessories about a riser system 28. For example six apertures may be employed to couple longitudinally extending accessories relative to riser system 28. When it is desirable to release one or more of the longitudinally extending accessories, each accessory may be individually released from an aperture via clamp 40. In certain embodiments combinations of longitudinally extending accessories may be released via a single clamp 40 or multiple clamps 40. Additionally, riser clamp 32 may be released from rig riser 42 via securing mechanisms disposed about multiplexed electronic and hydraulic lines 44.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the later filed claims.

What is claimed is:

1. A clamp for securing about an annular casing via a centrally oriented aperture having a radius comprising:

a generally planar body having a central aperture and a plurality of radial extensions for placement around a riser pipe independent of and between sections of floatation positioned around said riser pipe;

said extensions each partially engaging one end of said floatation across a flat surface of said extensions;

at least one of said extensions having a pivotable line clamp for releasably grasping a longitudinally extending accessory disposed bout the radius of the centrally oriented aperture; and said line clamp is retracted within an outer periphery of the floatation and extended beyond the outer periphery of the floatation when engaged with said longitudinal extending accessory.

2. The clamp for securing about annular casing via a centrally oriented aperture of claim 1 wherein said line clamp may be retracted to permit longitudinal removal of said clamp from said pipe while engaged with said riser pipe.

3. The clamp for securing about annular casing via a centrally oriented aperture of claim 1, wherein said clamp is positioned adjacent said floatation.

4. The clamp for securing about annular casing via a centrally oriented aperture of claim 1, wherein a portion of the clamp is capable of circumferentially releasing one or more longitudinally extending accessories.

5. The clamp for securing about annular casing via a circumferentially oriented aperture of claim 1, wherein a portion of the clamp is capable of removably detaching from the annular casing to release a single longitudinally extending member while coupling another longitudinally extending member.

6. A clamp for securing about annul casing via a centrally oriented aperture having a radius comprising:

a generally planar body having a central aperture and a plurality of radial extensions for placement about a riser pipe and between riser floats on said riser pipe;

said extensions each partially engaging one end of said floatation across a flat surface of said extensions;

at least one of said extensions having a releasable pivotable line clamp for grasping a longitudinally extending accessory disposed about the radius of the centrally oriented aperture; and said line clamp is retracted within an outer periphery of the floatation and extended beyond the outer periphery of the floatation when engaged with said longitudinal extending accessory.

7. The clamp for securing about annular casing via a centrally oriented aperture of claim 6 wherein said clamp supports at least one riser float.

8. The clamp for securing about annular casing via a centrally oriented aperture of claim 6 wherein said line clamp is comprised of two opposing pivoting members capable of an open and closed position.

9. The clamp for securing about annular casing via a centrally oriented aperture of claim 6 wherein said clamp is independent and not contained within said riser float.

10. The clamp for securing about annular casing via a centrally oriented aperture of claim 6 wherein said clamp is positioned between two riser floats.

11. The clamp for securing about annular casing via a centrally oriented aperture of claim 6 wherein said line clamp may be retracted to permit longitudinal removal of said clamp from said pipe while engaged with said riser pipe.

12. The clamp for securing about annular casing via a centrally oriented aperture of claim 6, wherein a portion of the clamp is capable of circumferentially releasing one or more longitudinally extending accessories.

13. The clamp for securing about annular casing via a circumferentially oriented aperture of claim 6, wherein a portion of the clamp is capable of removably detaching from the annular casing to release a single longitudinally extending member while coupling another longitudinally extending member.

14. A clamp for securing about annular casing via a centrally oriented aperture having a radius comprising:

a generally planar body having a central aperture and a plurality of radial extensions for placement around a riser pipe, said body independent and adjacent at least one riser float about said riser pipe;

at least one of said extensions having a releasable two-part pivotable line clamp for grasping a longitudinally extending accessory disposed about the radius of the centrally oriented aperture;

said extensions each partially engaging one end of said floatation across a flat surface of said extensions; and said line clamp is retracted within an outer periphery of the floatation and extended beyond the outer periphery of the floatation when engaged with said longitudinal extending accessory.

15. The clamp for securing about annular casing via a centrally oriented aperture of claim 14 wherein a portion of the clamp is capable of circumferentially releasing one or more longitudinally extending accessories.

16. The clamp for securing about annular casing via a centrally oriented aperture of claim 14 wherein said clamp is not contained within said riser float.

17. The clamp for securing about annular casing via a centrally oriented aperture of claim 14 wherein said line clamp is comprised of opposing pivotable members.

* * * * *